US007770308B2

(12) United States Patent
Leoncini

(10) Patent No.: US 7,770,308 B2
(45) Date of Patent: Aug. 10, 2010

(54) COVERING FOR AN ELASTICIZED BAND FOR A SHOE PROVIDED WITH A TONGUE

(75) Inventor: Fabio Leoncini, Borgosesia (IT)

(73) Assignee: Loro Piana S.p.A., Quarona (VC) (IT)

( * ) Notice: Subject to any disclaimer, the term of this patent is extended or adjusted under 35 U.S.C. 154(b) by 489 days.

(21) Appl. No.: 11/334,911

(22) Filed: Jan. 19, 2006

(65) Prior Publication Data

US 2006/0168848 A1 Aug. 3, 2006

(30) Foreign Application Priority Data

Jan. 31, 2005 (IT) ..... TO20050019 U

(51) Int. Cl.
*A43B 23/26* (2006.01)

(52) U.S. Cl. ..... 36/54; 36/51

(58) Field of Classification Search ..... 36/51, 36/54

See application file for complete search history.

(56) References Cited

U.S. PATENT DOCUMENTS 536,345 A 3/1895 Harris
2,361,675 A * 10/1944 Atkins ..... 36/51
3,037,303 A * 6/1962 Steuer ..... 36/51
3,952,430 A 4/1976 Pankin et al.
4,451,995 A 6/1984 Antonious
6,199,305 B1 3/2001 Steuerwald et al.

* cited by examiner

*Primary Examiner*—Ted Kavanaugh
(74) *Attorney, Agent, or Firm*—Merchant & Gould P.C.

(57) ABSTRACT

Described herein is a covering for an elasticized band for a shoe provided with a tongue; the shoe is of the type in which the upper, in a position corresponding to the instep of the foot, has a tongue contained between two sides flaps of the upper, and, inside the shoe, an elasticized band extends between the two flaps of upper in a position facing the tongue; the covering is constituted by a lining, which lines in bridge-like fashion the elasticized band from inside the shoe, and is fixed, on one side, to the upper, in the proximity of the edge of attachment of the tongue and, on the other side, to the end edge of the tongue itself.

3 Claims, 2 Drawing Sheets

COVERING FOR AN ELASTICIZED BAND FOR A SHOE PROVIDED WITH A TONGUE

The invention relates to a covering for an elasticized band for a shoe provided with a tongue.

Many types of shoes both for men and for ladies have a tongue in a position corresponding to the instep of the foot, which covers an underlying elasticized band.

The elasticized band joins the two sides of the upper, set between which is the tongue, and has the purpose of adapting that part of the shoe to the instep of the wearer's foot by stretching, when the instep is high, and by releasing when the instep is low.

By means of this elasticized band the shoe can adapt more easily to various types of feet at least in its uppermost part.

Elasticized bands, however, present some drawbacks, the most important of which that of frequently being somewhat troublesome in so far as they act directly on the instep of the foot, pressing against it when they are tensioned.

Furthermore, the inside of the shoe is not pleasant from the aesthetic standpoint of appearance and above all when the elasticized band has undergone deformation on account of slackening after a certain period of use of the shoe.

The purpose of the invention is to overcome the above drawbacks by proposing a solution whereby the elasticized band no longer presses directly on the instep of the foot and does not remain in view even after a prolonged use of the shoe.

In order to achieve the above and further purposes that will be understood more fully hereinafter, the invention purposes to provide a covering for an elasticized band of a shoe provided with a tongue, the shoe being of the type in which the upper, in an area corresponding to the instep of the foot, has a tongue contained between two lateral flaps of the upper, and, inside the shoe, an elasticized band extends between the two flaps of upper in a position facing the tongue, said covering being characterized in that it is constituted by a lining, which lines in a bridge-like fashion the elasticized band inside the shoe, and is fixed, on one side, to the upper, in the proximity of the edge of attachment of the tongue and, on the other side, to the end edge of the tongue itself.

The shoe according to the invention will now be described with reference to the attached plate of drawings, in which:

FIG. 1 illustrates a generic shoe, the purpose being purely that of highlighting the characteristic of the tongue 10 contained between two lateral flaps 11 of the upper.

FIG. 2 shows again the flaps 11 and the tongue 10 but from inside the shoe.

Figure 1:
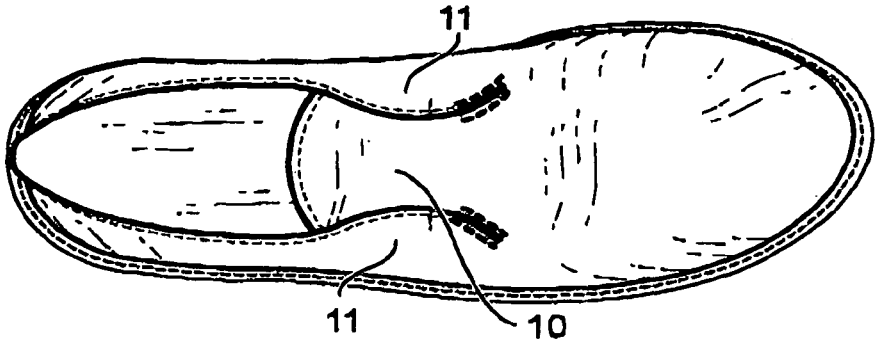
FIG. 1 illustrates a shoe provided with a tongue.
Figure 2:
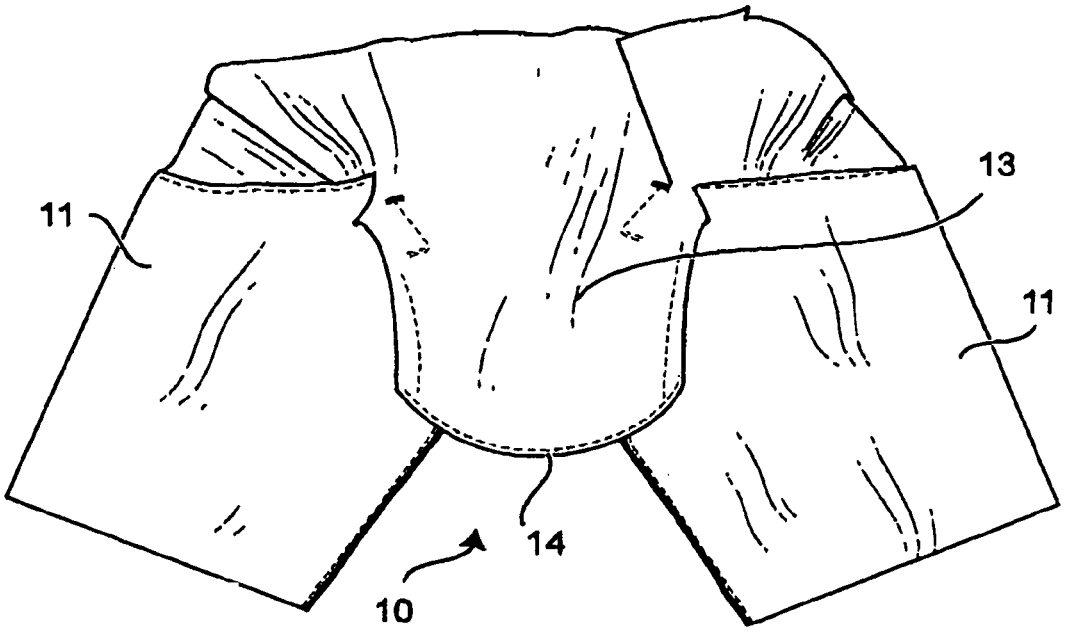
FIGS. 2, 3 and 4 illustrate a part of shoe according to the invention viewed from inside and in a position corresponding to the tongue in three different operating conditions.

In FIGS. 3 and 4 it is again possible to note the flaps 11 and the tongue 10, but it is also possible to note the elasticized band 12 that joins the two flaps 11.

During fabrication of the shoe, which has an outer upper and, normally, an inner lining, the parts of upper that will define the outside of the shoe are cut out in an altogether known way and, between the flaps 11, the ends of the elasticized band 12 will be sewn, once again in a known way.

According to the invention, it will instead be the internal lining 13 (see FIG. 4) which, instead of being sewn as is known along the edges of the tongue 10 while keeping the latter separated from the elasticized band 12, will be made to pass over the elasticized band 12 and then sewn only along its front edge 14 to the tongue 10 itself (see FIG. 3).

Figure 3:
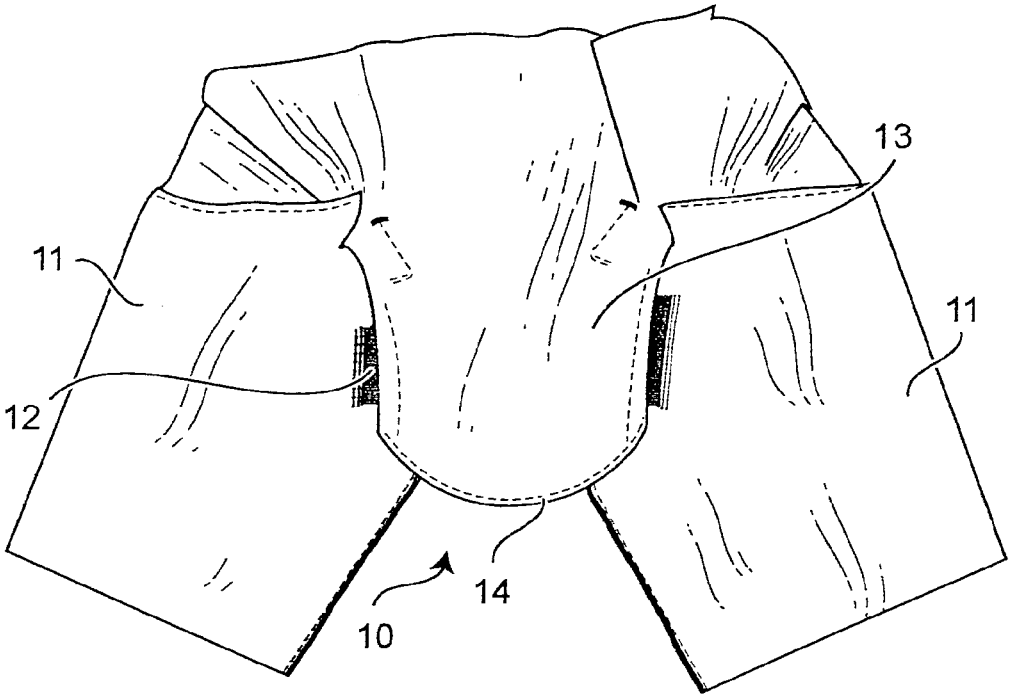
Figure 4:
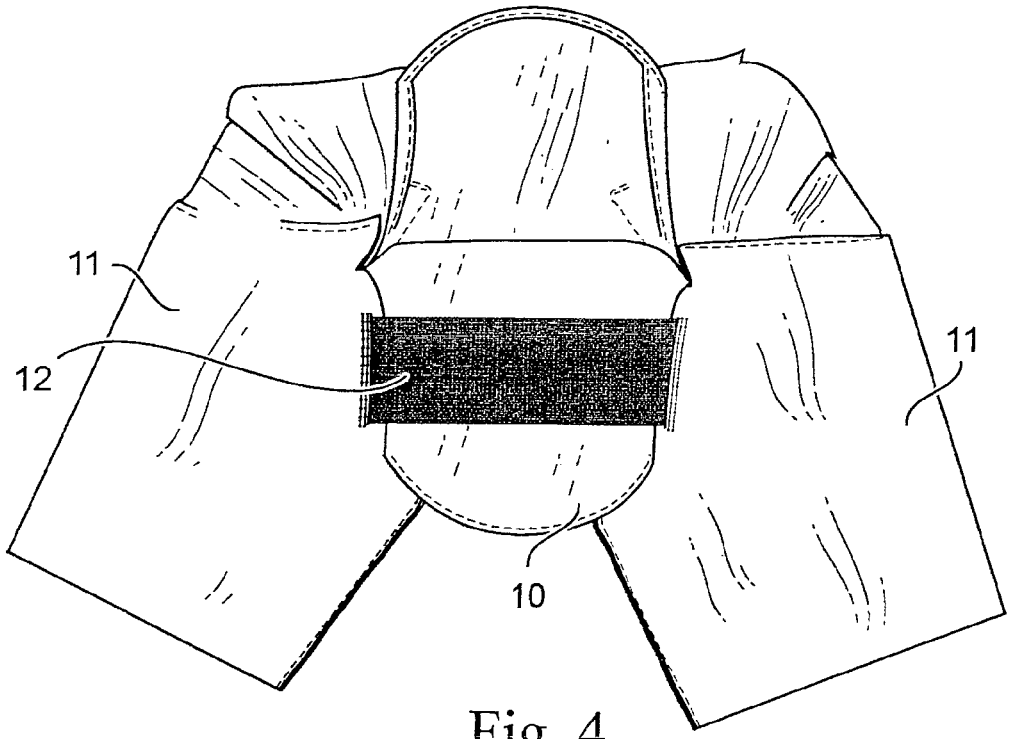

In this way, as may be noted in FIG. 3, the elasticized band 12 will be free to stretch under the lining 13, also projecting at the sides, as may be noted once again in FIG. 3, during use of the shoe, but being again hidden under the lining 14 when the shoe is not being used, as may be seen in FIG. 1.

In the case where the shoe were of the type without the internal lining, it will be sufficient to envisage a stretch of lining 13 that is sewn to the upper in the proximity of the edge of attachment of the tongue 10 and extends as far as the end edge of the tongue itself where it is sewn in 14 as in the case of the lining that lines the shoe completely.

The band of lining 14 that lines the elasticized band 11 in a bridge-like fashion causes the elasticized band itself never to be directly in contact with the instep of the foot, except for an extremely reduced lateral stretch if the band is stretched a lot, and this means that it is always and only the lining that remains in contact with the instep of the foot, without ever being tensioned and keeping the instep of the foot separate from the elasticized band.

In addition, when the inside of the shoe is examined, it seems as though it did not even have any elasticized band, which is a fact that renders the appearance of the article even more attractive.

The invention claimed is:

1. A shoe comprising:

a tongue;

a lining;

an upper in an area corresponding to the instep of the foot and having two side flaps, wherein the tongue is contained between the two side flaps of the upper;

an elasticized band inside the shoe, wherein the elasticized band extends between and is sewn to the two flaps of the upper and interposed between the tongue and the lining; wherein the lining is sewn only to the tongue and forms a covering over the elasticized band, wherein the elasticized band is free to stretch between the tongue and the lining during use of the shoe.

2. The covering according to claim 1, wherein the lining comprising the covering of the elasticized band is the lining of the shoe.

3. The covering according to claim 1, wherein the lining comprising the covering of the elasticized band is sewn to the upper in the proximity of the edge of attachment of the tongue.

* * * * *